United States Patent [19]

Heinrich

[11] 4,382,643

[45] May 10, 1983

[54] DESK STORAGE DEVICE

[76] Inventor: Richard H. Heinrich, 2614 Wood St., Elkhart, Ind. 46514

[21] Appl. No.: 192,618

[22] Filed: Sep. 30, 1980

[51] Int. Cl.[3] ..... A47B 19/00; A47B 41/00

[52] U.S. Cl. ..... 312/195; 312/117; 312/196; 108/64

[58] Field of Search ..... 312/195, 194, 196, 283, 312/286, 312, 117, 306; 108/64, 65

[56] References Cited

U.S. PATENT DOCUMENTS

| | | | |
|---|---|---|---|
| 4,252 | 11/1845 | White | 312/312 |
| 1,428,629 | 9/1922 | Gunn | 312/312 |
| 1,486,176 | 3/1924 | Wolters | 312/312 |
| 2,244,211 | 6/1941 | Nelson | 312/312 |
| 2,821,450 | 1/1958 | Knoll | 312/195 |
| 3,437,390 | 4/1969 | Evans | 312/196 |
| 3,717,395 | 2/1973 | Spielvogel et al. | 312/117 |
| 4,049,331 | 9/1977 | Gutmann, Jr. | 312/195 |

FOREIGN PATENT DOCUMENTS

| | | | |
|---|---|---|---|
| 347318 | 8/1960 | Switzerland | 312/195 |
| 615814 | 2/1980 | Switzerland | 108/64 |

*Primary Examiner*—Victor N. Sakran
*Attorney, Agent, or Firm*—James D. Hall

[57] ABSTRACT

A storage device to be used in combination with classroom desks. The device is four sided with a compartment formed in each side. The device mounts on the tops of two oppositely facing desks.

4 Claims, 3 Drawing Figures

DESK STORAGE DEVICE

SUMMARY OF THE INVENTION

This invention relates to a storage device and will have specific application to a storage device used with classroom desks.

Students, especially those in grade schools, have a difficult time fitting all of their books and school supplies in the shelves of their desks. The present invention serves to alleviate this problem by providing an additional storage compartment for two to four desks.

The invention is a storage device which is supported between two desks. The storage device includes compartments which are located adjacent the top of each desk and which provide the students with additional personal storage space.

Accordingly, it is an object of this invention to provide additional storage area for students' desks.

Another object is to provide a storage device to combine with desks to form a space efficient study area.

Still anther object is to provide additional work areas which can be used in conjunction with the students' desks to accommodate specific group activities.

Other objects will become apparent upon a reading of the following description.

DESCRIPTION OF THE PREFERRED EMBODIMENT

Figure 1:
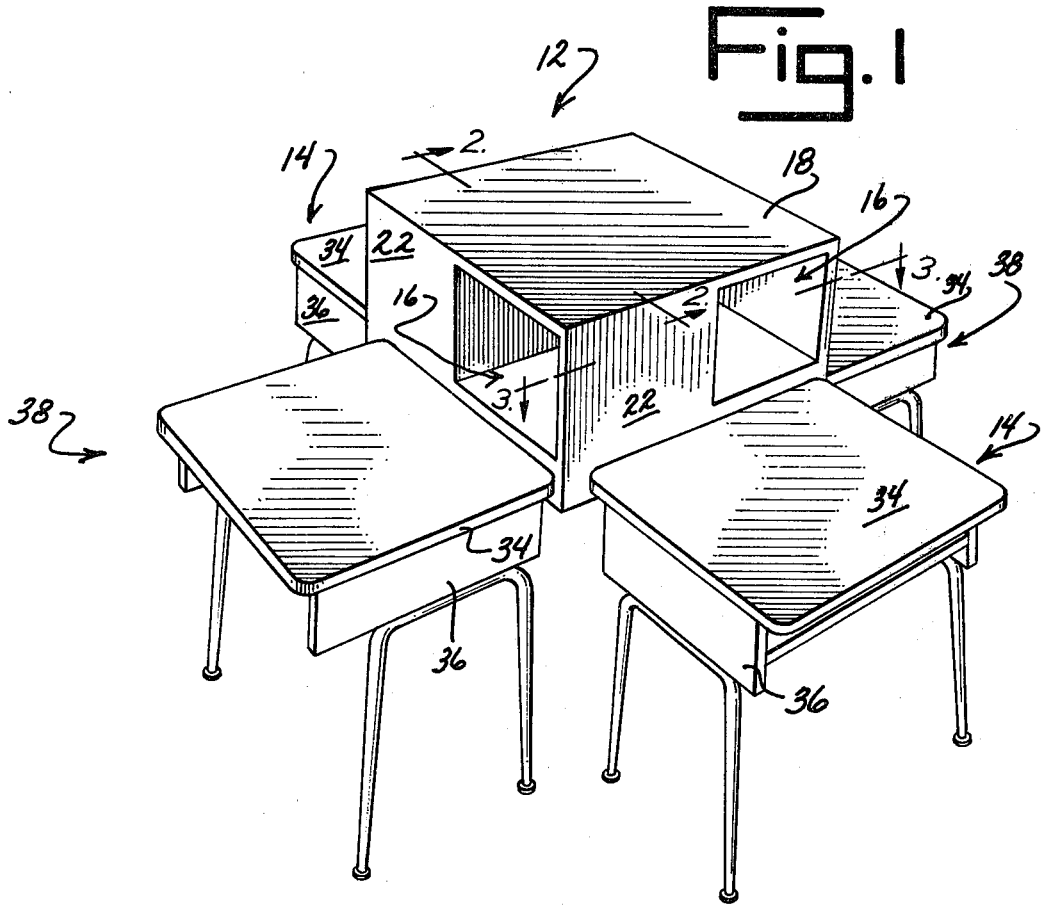
FIG. 1 is a perspective view of the storage device used with four desks.
Figure 2:
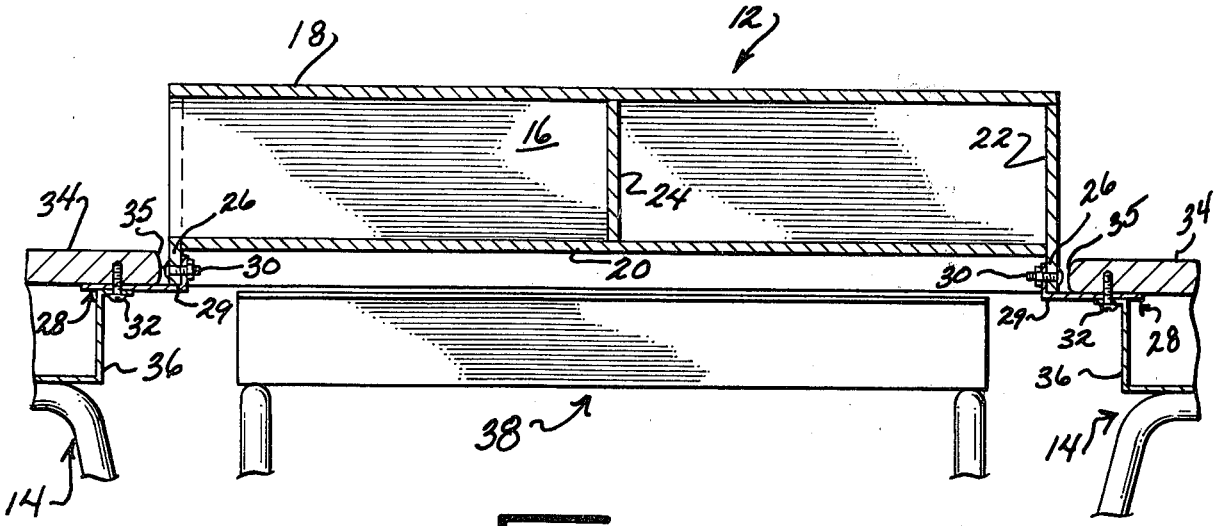
FIG. 2 is a side cross sectional view of the device as seen along line 2—2 of FIG. 1.

The preferred embodiment illustrated is not intended to be exhaustive or to limit the invention to the precise form disclosed. It is chosen and described in order to best explain the principles of the invention, its application and practical use to thereby enable others skilled in the art to best utilize the invention.

Referring to the drawings, desk storage device 12 is used in combination with four desks 14, 38. Storage device 12 has four compartments 16 formed between the top 18, bottom 20, and side walls 22. Internal walls

Figure 3:
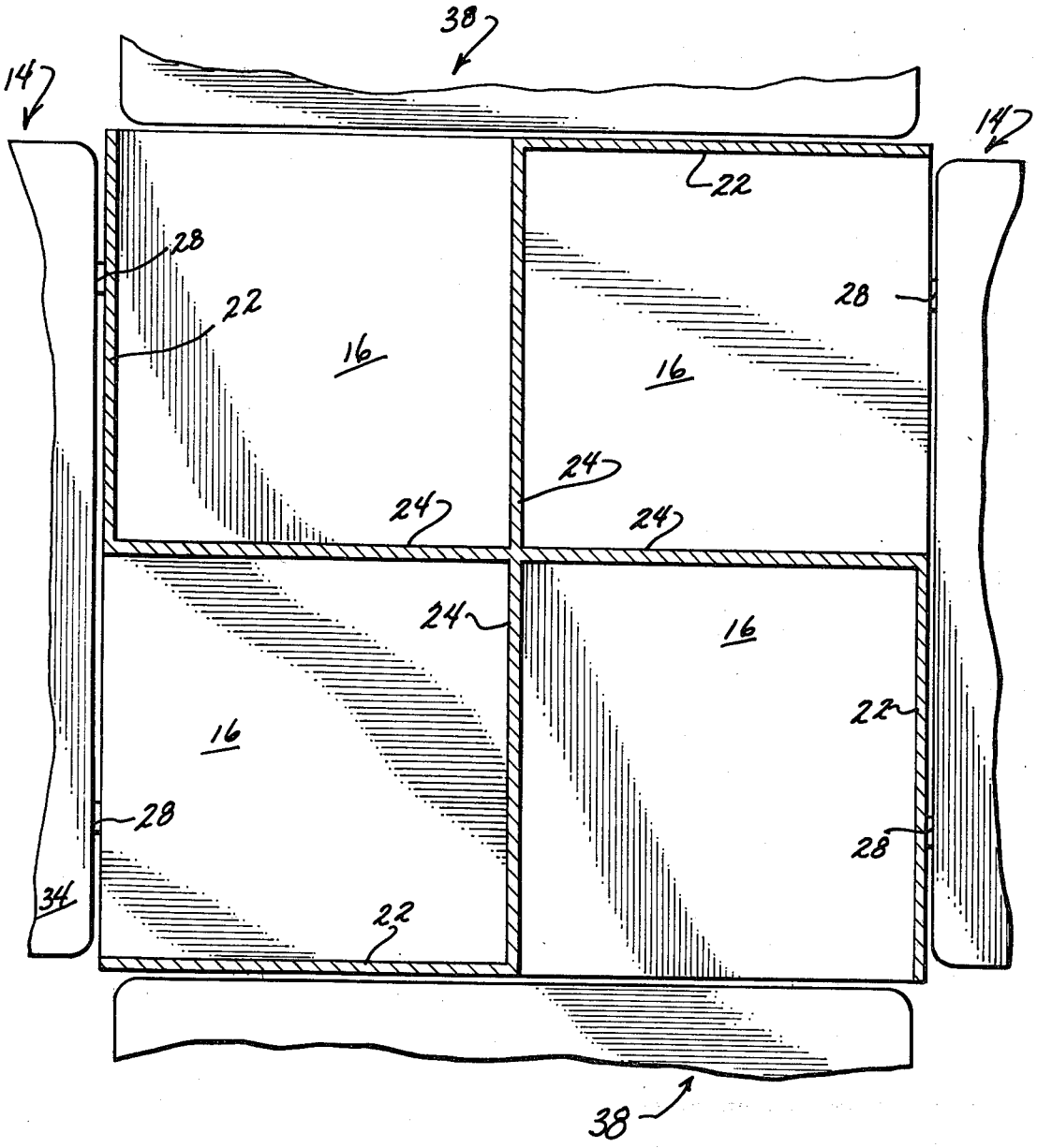
FIG. 3 is a top cross sectional view of the device as seen along line 3—3 of FIG. 1.

24 form common side and back walls for compartments 16, as shown in FIG. 3, sidewalls 22 extend below bottom 20 to form a flange 26.

Two desks 14 are used to support storage device 12. A pair of brackets 28 is secured by screws 32 between body 36 and top 34 of each desk 14. Each bracket 28 includes a lip 29 which is spaced from the edge 35 of its connected desk top 34. Side wall flange 26 of storage device 12 fits between bracket lips 29 and desk top edge 35, resting upon brackets 28. A nut and bolt 30 may be used to secure flange 26 to brackets 28 at lips 29 if desired. Storage device 12 is thus supported between the two desks 14. An increased study area can be obtained by adding one or two other desks 38. Extra desks 38 need not be attached to storage device 12, thereby allowing for their addition or removal as needed. Each compartment 16 is located near the level of an opposite desk top within reach of the student.

It is understood that the invention is not to be limited to the preceding description but may be modified within the scope of the appended claims.

I claim:

1. In combination, a desk storage device and two desks; said device including a central body defined by four lateral sides, a top, and a bottom; at least two of said sides having a compartment formed therein; each desk including a top; said desks being spaced apart with the tops thereof in an opposed relationship; said desks supporting said device between the tops of the desks with a said compartment located opposite a desk top for storage, each side of said body having a compartment formed therein; each compartment being formed by a top, a bottom, two side walls and a rear wall; in each compartment one of said side walls forms one of said lateral sides and the other of said side walls forms the rear wall of another compartment.

2. The storage device of claim 1 and a third desk including a top; each desk having a said compartment located opposite its top.

3. The storage device of claim 2 and a fourth desk including a top.

4. The storage device of claim 1 wherein said lateral faces extend downwardly from said central body to form a flange; brackets attached to said desk tops and supporting said device.

* * * * *